US007594648B2

(12) United States Patent
Wattyn

(10) Patent No.: US 7,594,648 B2
(45) Date of Patent: Sep. 29, 2009

(54) GRIPPING UNIT AND A METHOD FOR GRIPPING A PAPER

(75) Inventor: Bart Marc Luc Wattyn, Dentergem (BE)

(73) Assignee: Punch Graphix International N.V., Lier (BE)

( * ) Notice: Subject to any disclaimer, the term of this patent is extended or adjusted under 35 U.S.C. 154(b) by 116 days.

(21) Appl. No.: 11/755,848

(22) Filed: May 31, 2007

(65) Prior Publication Data

US 2007/0280769 A1 Dec. 6, 2007

(30) Foreign Application Priority Data

Jun. 1, 2006 (EP) ..... 06076146

(51) Int. Cl.
*B65H 3/30* (2006.01)

(52) U.S. Cl. ..... 271/21; 271/97

(58) Field of Classification Search ..... 271/21, 271/19, 16, 97

See application file for complete search history.

(56) References Cited

U.S. PATENT DOCUMENTS 5,180,155 A * 1/1993 Asai ..... 271/21
6,474,711 B2 * 11/2002 Kazerooni et al. ..... 294/86.4
6,554,337 B2 * 4/2003 Kazerooni et al. ..... 294/86.4
2002/0113448 A1 8/2002 Kazerooni et al.

FOREIGN PATENT DOCUMENTS

| | | | |
|---|---|---|---|
| DE | 4121190 | A1 | 1/1992 |
| EP | 1510481 | A | 3/2005 |
| WO | 2005113242 | A | 12/2005 |

OTHER PUBLICATIONS

Europe Search Report.

* cited by examiner

*Primary Examiner*—David H Bollinger
(74) *Attorney, Agent, or Firm*—Quarles & Brady LLP

(57) ABSTRACT

A gripping unit for gripping a paper from a top surface of a stack includes a first and a second friction wheel having rotation axes that are mainly parallel with respect to each other. The friction wheels are arranged to exert a friction force on sections of a paper. Further, the gripping unit comprises an actuator on which the first friction wheel is mounted for moving the first friction wheel towards the second friction wheel. The first friction wheel is arranged to rotate with respect to its axis during the movement towards the second friction wheel such that a paper section on which the first wheel exerts the friction force is forced into the direction of the second friction wheel.

12 Claims, 5 Drawing Sheets

GRIPPING UNIT AND A METHOD FOR GRIPPING A PAPER

CROSS REFERENCES TO RELATED APPLICATIONS

This application claims the priority benefit of EP 06076146.7 filed on Jun. 1, 2006.

STATEMENT REGARDING FEDERALLY SPONSORED RESEARCH

Not Applicable.

BACKGROUND OF INVENTION

The invention relates to a gripping unit for gripping a paper from a top surface of a stack, comprising a first and a second friction wheel having rotation axes that are mainly parallel with respect to each other and being arranged to exert a friction force on sections of a paper, the gripping unit further comprising an actuator on which the first friction wheel is mounted for moving the first friction wheel towards the second friction wheel.

Such a gripping unit for griping a paper is e.g. known in the field of computer-to-plate imaging processes, wherein printing plates are picked up from a multiple plate stack. In the stack each printing plate is sandwiched between a paper sheet to avoid damages on the surface of the plates and to avoid interaction of the printing plates surfaces, which are regularly manufactured from aluminium. In the process of handling the printing plates, elements on the stack are sequentially removed, thus in an alternating way a printing plate and a paper sheet. The printing plates are e.g. handled for processing, e.g. by exposing radiation to the printing plate. The paper sheets are removed and deposited in a box.

To remove a paper which is located on a top surface of the stack, the known gripping unit is positioned above the paper, such that the first and second friction wheels exert a friction force on sections of the paper. Then the actuator of the gripping unit moves the first friction wheel from the initial position towards the second friction wheel, so that the paper between the two friction wheels is folding upwardly and subsequently pressed between vertically oriented contact portions of the friction wheels facing each other. The paper can then be removed from the stack.

However, due to limitations which are posed by other parts of the system, it is desired that the distance between both friction wheels in the initial position is reduced, thereby also reducing the distance that the paper is moved upwards during the folding and gripping operation. As a consequence, the chance that a paper is reliably gripped by the gripping unit diminishes.

SUMMARY OF THE INVENTION

It is an object of the invention to provide a gripping unit according to the preamble, wherein the disadvantage identified above is reduced. In particular, the invention aims at obtaining a gripping unit wherein during the initial stage the first and the second friction wheels can be placed more close to each other, while the reliability of the unit remain at least the same. Thereto, according to an aspect of the invention, the first friction wheel is arranged to rotate with respect to its axis during the movement towards the second friction wheel, such that a paper section on which the first wheel exerts the friction force is forced into the direction of the second friction wheel.

By rotating the first friction wheel with respect to its axis during the movement of the first friction wheel into the direction of the second friction wheel, such that a paper section on which the first wheel exerts the friction force is forced into the direction of the second friction wheel, the paper more reliably folds and bends upwardly as the paper section below the first friction wheel is forced towards the paper section below the second friction wheel. Since the reliability of the gripping unit increases, the first and the second friction wheels can be placed more close to each other during the initial stage of the gripping process.

Since the gripping unit according to the invention functions more reliably, the chance that a specific paper sheet on top of the stack layer is removed in a controllable manner, increases, even if the sheet on the top surface of the stack is already folded or rotated.

Moreover, due to its improved gripping characteristics the gripping unit can be used to remove a paper in situations where a vertical working space is limited, e.g. in the case that a paper has to be removed, while a printing plate positioned right above the paper sheet is partially lifted for removal. Further, it is not necessary to move the gripping unit according to the invention towards the centre of the sheet to grip the paper, it might be sufficient to grip a paper near a border region of the paper.

By arranging the first friction wheel to rotate with respect to its axis during the movement towards the second friction wheel such, that a contact portion of the first friction wheel exerting the friction force on the paper section is substantially moving towards the second friction wheel, the effect is obtained that the paper is more easily folded upwardly as the amount of paper between the friction wheels increases. As a matter of fact, the folding phenomenon is not only caused by diminishing the mutual distance between the first and section friction wheels, but also by rotation of the first friction wheel. As a larger amount of paper is folded up, the initial distance between the first and second friction wheels can even further be reduced without reducing the reliability properties of the gripping unit.

In an advantageous embodiment according to the invention, the second friction wheel is arranged to rotate with respect to its axis during the movement of the first friction wheel such, that a contact portion of the second friction wheel exerting the friction force on a second paper section is substantially moving towards the first friction wheel. In this way, the amount of paper between the friction wheels is further enlarged, so that the paper is even more easily folded upwardly. However, it is also possible to arrange the second friction wheel such, that the wheel does not perform a rotation with respect to its axis during the gripping action, e.g. by exerting a friction force on the paper that is so large that the second friction wheel essentially does not rotate.

More advantageously, the rotation of the first friction wheel is driven by the actuator for moving the first friction wheel towards the second friction wheel. Thereby the movement of the first friction wheel towards the second friction wheel and the rotation of the friction wheel with respect to its axis might be performed by a single motor, thus reducing a motor equipment, costs and space in the gripping unit. Alternatively, the gripping unit is provided with a second actuator mechanism to drive the first friction wheel in a rotational way with respect to its axis.

In embodiment according to the invention, the first friction wheel is mounted on a first axle being provided with an additional friction wheel to improve the friction force exerted on the paper to be gripped. In a simpler implementation, the first friction wheel is not coupled to an additional friction wheel, either by absence of the additional friction wheel or by missing a common axle. However, it is also possible to implement one or a multiple number of additional friction wheels having axes that mainly coincide with the axis of the first friction wheel or that are mainly parallel with it. Optionally, the one or multiple number of additional friction wheels can be moved during the gripping action towards the second friction wheel and/or rotated such, that a paper section on which the first wheel exerts the friction force is forced into the direction of the second friction wheel.

In a similar way, the second friction wheel can be mounted on a second axle being provided with an additional friction wheel. Of course, similar variants as described with respect to the additional friction wheels of the first friction wheel, are possible.

Optionally, the gripping unit according to the invention further comprises an airflow generator for providing a flow of air between a paper being gripped and a surface below the paper, so that adhesion forces between the paper and the surface below the paper, e.g. a printing plate, are counteracted and the paper can be removed more easily from the surface below the paper. However, it is also possible to counteract the adhesion force otherwise, e.g. by removing the paper mechanically from the surface below the paper, e.g. by performing a translation between the paper and the said surface.

Moreover, the gripping unit according to the invention might further comprise an airflow generator for providing a flow of air between a paper to be gripped and a surface above the paper, so that adhesion forces between the paper and the surface above the paper, e.g. a printing plate, are counteracted and the paper can be removed more easily while the surface above the paper is also being removed. As described above, it is also possible to counteract the adhesion forces otherwise, e.g. mechanically by performing a translation between the paper and said surface.

In a further advantageous embodiment, the gripping unit according to the invention further comprises a guiding element for removing from the stack an element having a surface above the paper to be gripped. Thereby, actions performed by the gripping unit to remove a paper might advantageously cooperate with operations that are carried out to remove an element having a surface above the paper, such as a printing plate. One could however also implement different mechanisms for performing the above mentioned acts, so that mutual interaction is avoided.

Other advantageous embodiments according to the invention are described in the following claims.

The invention relates also to a method for gripping a paper.

BRIEF DESCRIPTION OF THE DRAWINGS

By way of example only, embodiments of the present invention will now be described with reference to the accompanying figures in which.

The figures are merely schematic views of preferred embodiments according to the invention. In the figures, the same reference numbers refer to equal or corresponding parts.

DETAILED DESCRIPTION OF PREFERRED EMBODIMENTS

Figure 1:
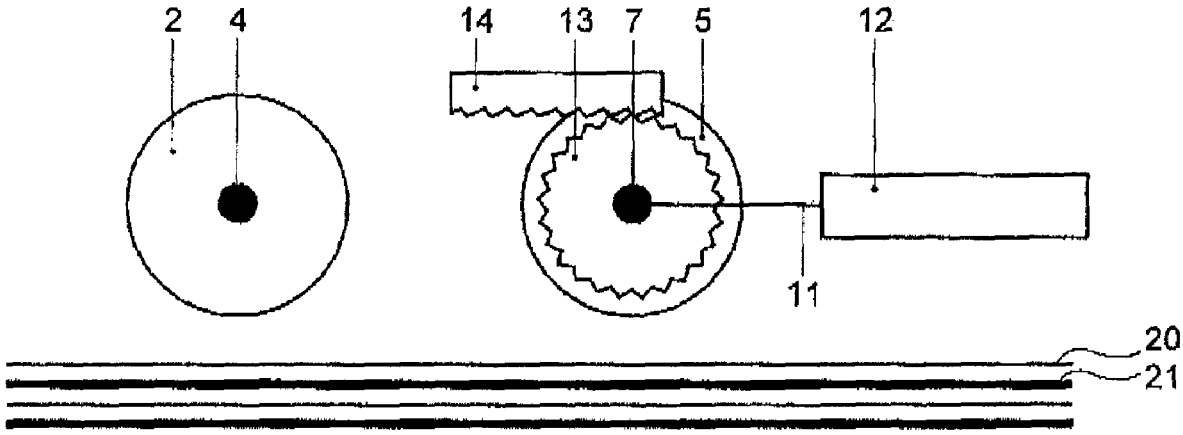
FIG. 1 shows a schematic side view of a gripping unit according to the invention in a first stage of a gripping process.

FIG. 1 shows a schematic side view of gripping unit according to the invention in a first stage of a gripping process. The gripping unit 1 comprises a first friction wheel 5 and a second friction wheel 2 each having a rotation axis that coincides with a rotation axle 7, 4, respectively, of the respective friction wheel 5, 2. The rotation axes are mainly parallel with respect to each other. The first and second friction wheel 5, 2 are arranged to exert a friction force on sections of a paper below the wheels 5, 2 as is described below.

The gripping unit 1 further comprising an actuator 12 on which the first friction wheel 5 is mounted for moving the first friction wheel 5 towards the second friction wheel 2. In addition, the first friction wheel 5 is arranged to rotate with respect to its axis during the movement towards the second friction wheel 2 such that a paper section 20 on which the first wheel exerts the friction force is forced into the direction of the second friction wheel 5.

To that end the rotation of the first friction wheel 5 is caused by the actuator 12 for moving the first friction wheel 5 towards the second friction wheel 2. In particular, the first friction wheel 5 is driven by a tooth wheel transmission. Obviously, other transmission systems could also be applied, such as a belt transmission. The first friction wheel 5 is fixedly provided with a gear wheel 13 cooperating with a gear rack 14 that is fixed with respect to the axle 4 of the second friction wheel 2.

In the first stage of the gripping process, the gripping unit 1 is positioned above a stack comprising printing plates 21 that are sandwiched between individual paper sheets 20. The top surface of the stack is formed by a paper sheet 20 that is to be removed by the paper gripper 1.

Figure 2:
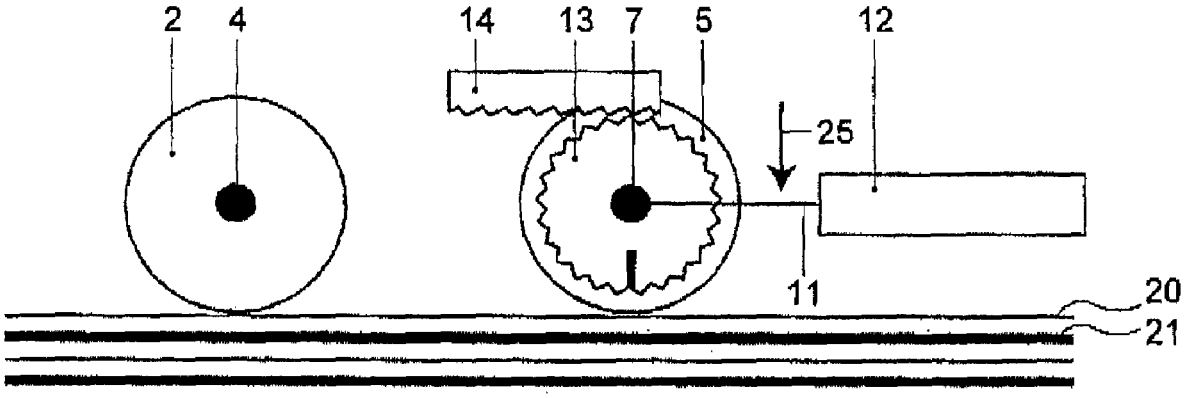
FIG. 2 shows a schematic side view of a gripping unit according to the invention in a second stage of a gripping process.

During a second stage of the gripping process, the gripping unit 1 is pushed in a downward direction 25 against the paper 20 to exert friction forces on paper sections by means of the first and second friction wheel 5, 2. This second stage is shown in FIG. 2.

Figure 3:
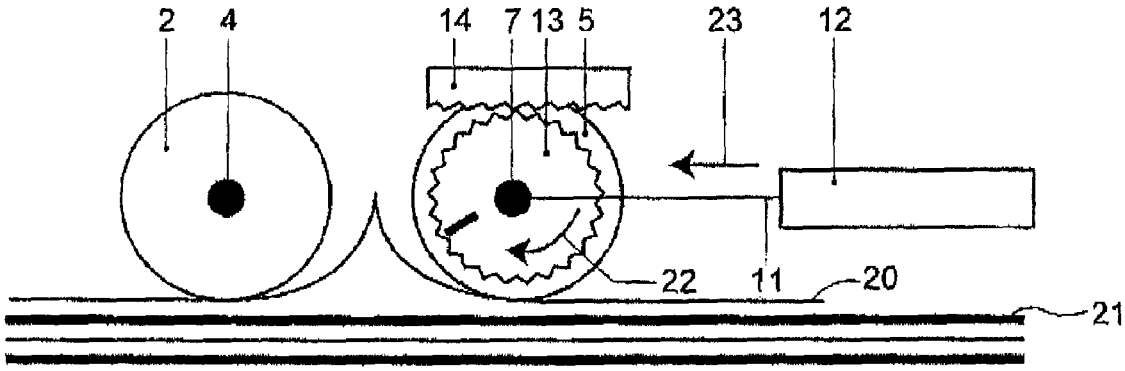
FIG. 3 shows a schematic side view of a gripping unit according to the invention in a third stage of a gripping process.

In a third stage of the gripping process, shown in FIG. 3, the first friction wheel 5, upon activation of the actuator 12, is moving in a direction 23 towards the second friction wheel 2, while rotating the first friction wheel 5 in a clockwise direction 22. The movement of the first friction wheel 5 forms substantially a translation. The rotation of the first friction wheel 5 is such, that a contact portion of the first friction wheel 5 exerting the friction force on the paper section is substantially moving towards the second friction wheel 2. The rotation of the wheel 5 is forced by the translation of the first friction wheel 5 and the gear transmission comprising the gear wheel 13 and the gear rack 14. By the actions of the first friction wheel 5, the paper 20 folds and extends upwardly between the first and second friction wheels 5, 2.

It is noted that the movement of the first friction wheel 5 caused by the actuator 12 can also be non-planar, e.g. curved. Further, the actuator 12 might be designed such, that the first friction wheel 5 follows the top surface of the stack.

Figure 4:
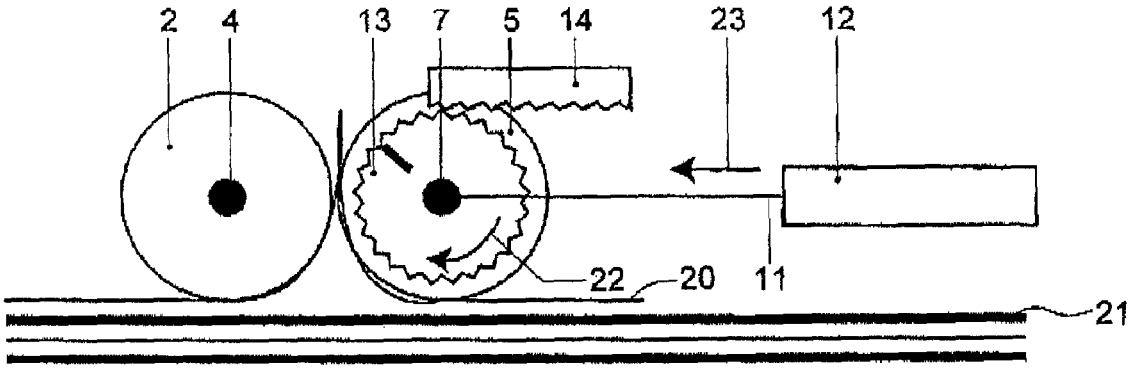
FIG. 4 shows a schematic side view of a gripping unit according to the invention in a fourth stage of a gripping process.
Figure 5:
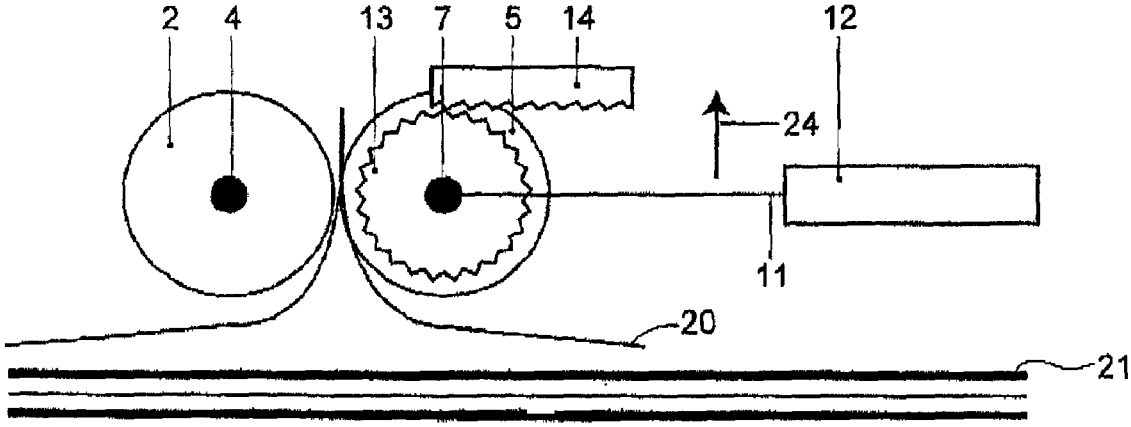
FIG. 5 shows a schematic side view of a gripping unit according to the invention in a fifth stage of a gripping process.

During a fourth stage of the gripping process, shown in FIG. 4, the first friction wheel 5 abuts against the second friction wheel 2, thereby clamping the curved paper 20 between them.

In a fifth stage of the gripping process the gripping unit 1 is moving in an upward direction 24, away from the stack to drop the paper 20 adjacent the stack. The printing plate 21 then forms the top surface of the stack.

It is noted that the first friction wheel can also be arranged to rotate during the movement towards the second friction wheel such, that a contact portion of the first friction wheel exerting the friction force on the paper section is substantially moving away from the second friction wheel, in other words performing a counter clockwise rotation. In this way, the distance of the paper between the friction wheels increases. However, the friction force that is exerted by the first friction wheel 5 on the paper 20 can also increase. As a result, the gripping unit 1 may obtain an improved reliability. This is especially the case if the initial distance between the friction wheels 5, 2 is relatively large.

The second friction wheel 2 is not motor driven, but is freely rotatable with respect to its axis that coincides with the axle 4, on which the second friction wheel 2 is mounted. Since the second friction wheel 2 is freely rotatable, wear of the wheel 2 is evenly distributed over the entire circumferential surface of the wheel 2. In a preferred embodiment, the second friction wheel 2 is allowed to rotate in one direction only to more evenly distribute the wear over its entire circumferential surface.

Figure 6:
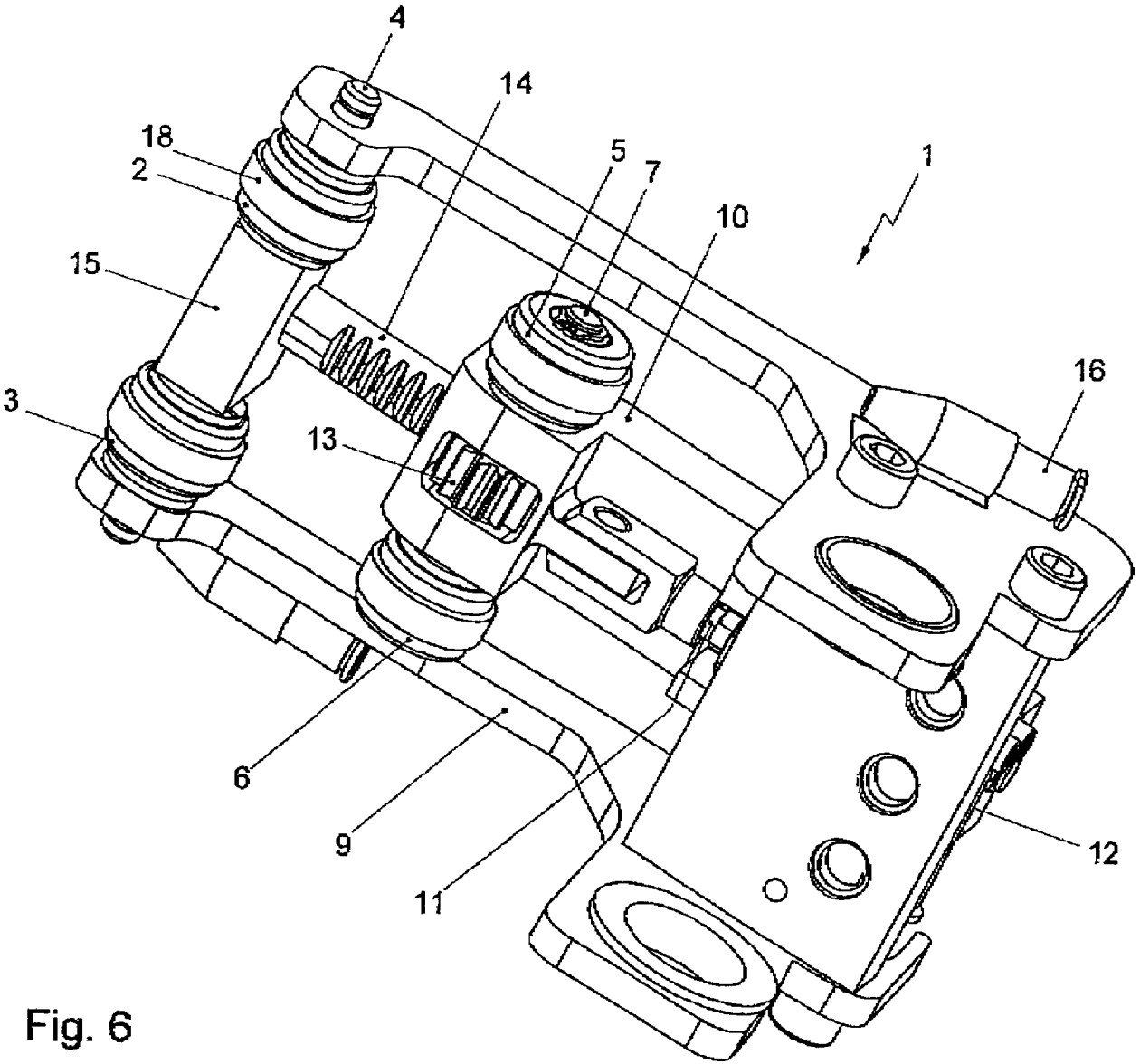
FIG. 6 shows a schematic perspective view of the gripping unit of FIG. 1 from below.
Figure 7:
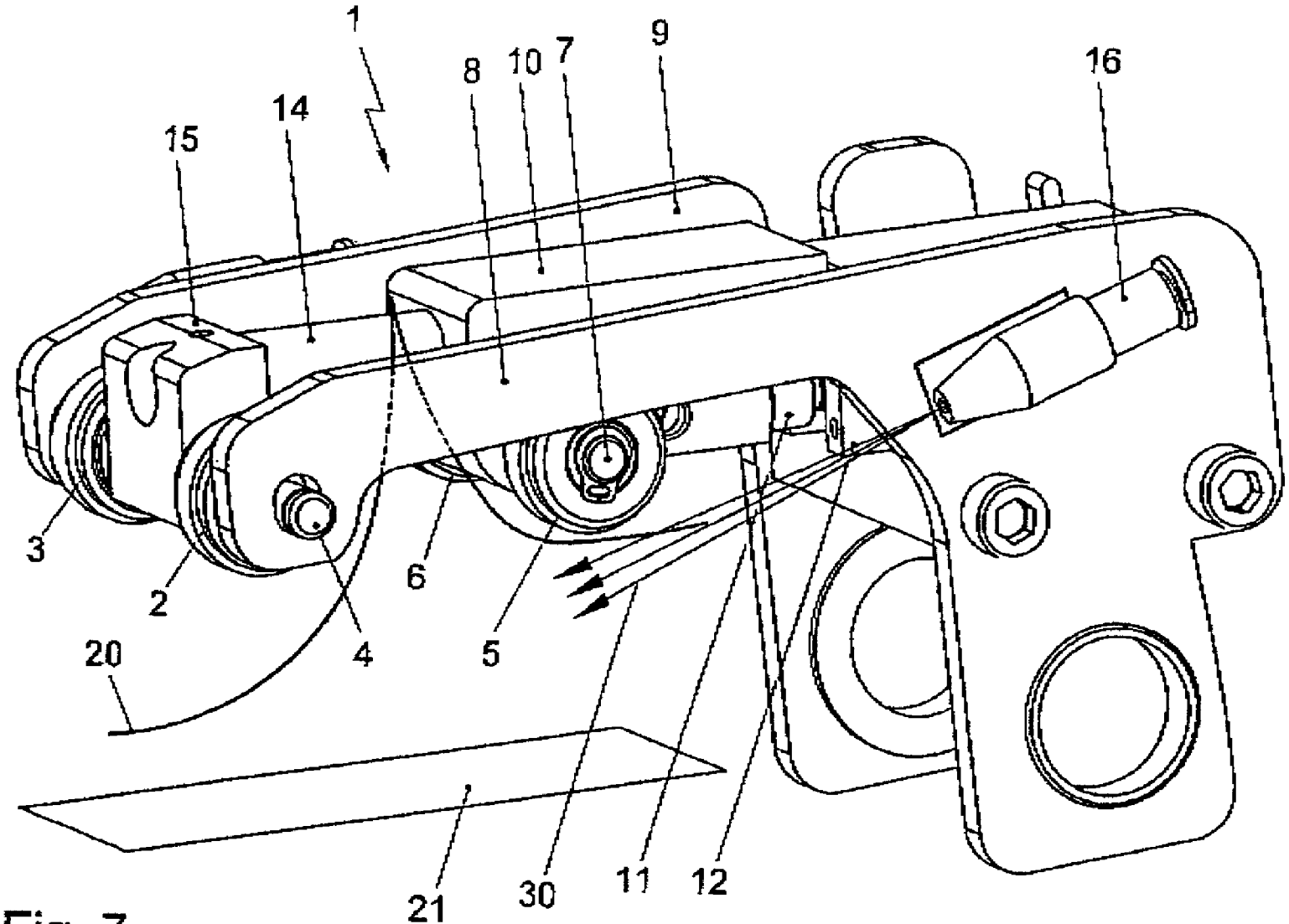
FIG. 7 shows a schematic perspective view from a first side of the gripping unit of FIG. 1.
Figure 8:
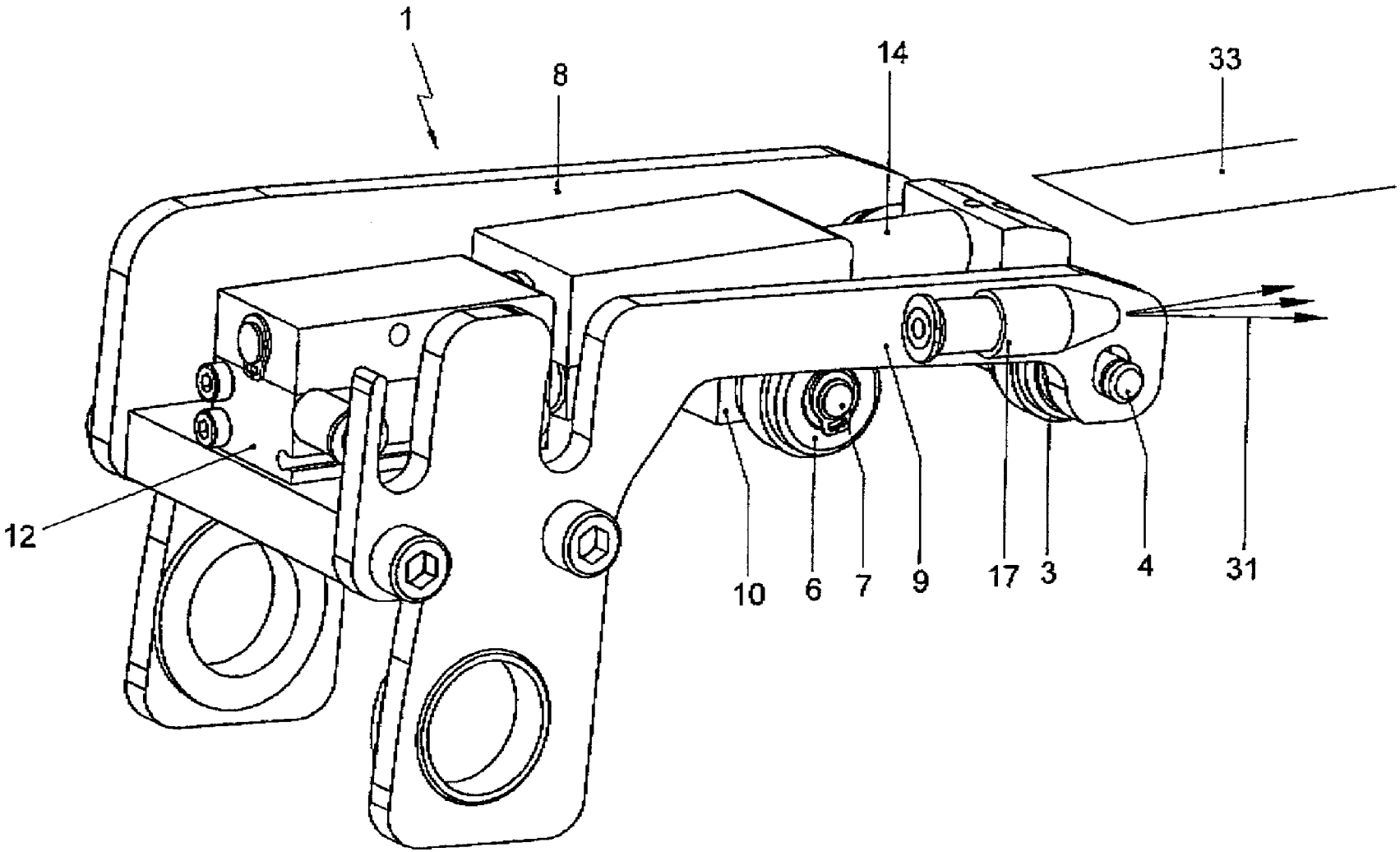
FIG. 8 shows a schematic perspective view from a second side of the gripping unit of FIG. 1.

FIGS. 6-8 show schematic perspective views of the gripping unit 1 in more detail respectively from below, a first side and a second side. On the axle 7 of the first friction wheel 5 an additional friction wheel 6 is mounted to form a first pair of friction wheels 5, 6 and to enhance the grip on the paper 20 below the wheels 5, 6. Similarly, the second friction wheel 2 forms a second pair of second friction wheels 2, 3 with an additional friction wheel 3 that is mounted on the axle 4 which also carries the second friction wheel 2. As a consequence, a stable grip on the paper 20 can be obtained.

The axle 4 of the second pair of friction wheels 5, 6 is at its first and second end rotatably mounted on ends of a first and second arm 8, 9 that extend substantially parallel and are mounted to form a frame carrying the gripping unit 1. Further, the axle 4 carries between the second pair of wheels 2, 3 a block on which a gear rack 14 is mounted that extends substantially parallel with the first and second arm 8, 9 in the direction of the first pair of friction wheels 5, 6. The gear rack 14 engages with the gear wheel 13 on the axle 7 carrying the first pair of friction wheels 5, 6.

The axle 7 of the first pair of friction wheels 5, 6 is carried by a carrier unit 10 that is connected to the actuator 12. The actuator 12 is fixed to an end of both arms 8, 9 and comprises an electrical motor to drive a movable connection 11 with the carrier unit 10. In the embodiment shown in FIGS. 6-8 the movable connection 11 is implemented as a pair of hydraulic cylinders. Obviously, also other type of actuators could be applied, such as a pair of air cylinders or a single movable cylinder.

As particularly shown in FIG. 8, the gripping unit 1 is further provided with an air flow generator 17 for providing a flow of air 31 between a paper 20 to be gripped and a surface above the paper 20. By activating the air flow generator the paper 20 can more easily be removed from e.g. a printing plate 33 being located above the paper 20, being partly withdrawn from the stack by some mechanism and having the surface above the paper 20.

In addition, the gripping unit 1 is provided with an air flow generator 16 for providing a flow of air 30 between a paper 20 to be gripped and a surface below the paper 20, thereby facilitating the removal of the paper 20 being gripped from the surface below the paper 20 that e.g. belongs to the printing plate 21.

It is noted that the top surface of the first and second arm 8, 9 form a guiding element for removing from the stack an element having a surface above the paper to be gripped. Further, the gripping unit 1 as a whole is rotatable with respect to an axis near the actuator 12 and substantially parallel with the axles 4, 7 of the pair of friction wheels 2, 3, 5, 6.

The invention is not restricted to the embodiments described herein. It will be understood that many variants are possible.

As shown in FIGS. 6-8, each friction wheel 2, 3, 5, 6 is provided with a friction tire 18 that is arranged such that a relatively large frictional force can be applied to the paper 20 below the wheels. Thereto the friction tires 18 have elastic properties. In stead of applying the friction tires, other means could be applied to enhance the friction force to be exerted, e.g. elastic portions on the circumferential surface of one or more of the friction wheels 2, 3, 5, 6.

Other such variants will be obvious for the person skilled in the art and are considered to lie within the scope of the invention as formulated in the following claims.

I claim:

1. A gripping unit for gripping a paper from a top surface of a stack, comprising a first friction wheel and a second friction wheel, said first friction wheel and second friction wheel having rotation axes that are mainly parallel with respect to each other and being arranged to exert a friction force on sections of a paper, the gripping unit further comprising an actuator on which the first friction wheel is mounted for moving the first friction wheel towards the second friction wheel, wherein the first friction wheel is arranged to rotate with respect to its axis during the movement towards the second friction wheel such that a paper section on which the first wheel exerts the friction force is forced into the direction of the second friction wheel, said gripping unit further comprising an airflow generator providing a flow of air between a paper being gripped and at least one of a surface below the paper and a surface above the paper.

2. A gripping unit according to claim 1, wherein the first friction wheel is arranged to rotate with respect to its axis during the movement towards the second friction wheel such, that a contact portion of the first friction wheel exerting the friction force on the paper section is substantially moving towards the second friction wheel.

3. A gripping unit according to claim 1, wherein the second friction wheel is arranged to rotate with respect to its axis during the movement of the first friction wheel such, that a contact portion of the second friction wheel exerting the friction force on a second paper section is substantially moving towards the first friction wheel.

4. A gripping unit according to claim 1, wherein the movement of the first friction wheel forms substantially a translation.

5. A gripping unit according to claim 1, wherein the rotation of the first friction wheel is driven by the actuator for moving the first friction wheel towards the second friction wheel.

6. A gripping unit according to claim 1, wherein the first friction wheel is driven by a tooth wheel transmission.

7. A gripping unit according to claim 1, wherein the first friction wheel is fixedly provided with a gear wheel cooperating with a gear rack that is fixed with respect to the axis of the second friction wheel.

8. A gripping unit according to claim 1, wherein the first friction wheel is mounted on a first axle being provided with one or more additional friction wheels.

9. A gripping unit according to claim 1, wherein the second friction wheel is mounted on a second axle being provided with one or more additional frictional wheels.

10. A gripping unit for gripping a paper from a top surface of a stack, comprising a first friction wheel and a second friction wheel, said first friction wheel and second friction wheel having rotation axes that are mainly parallel with respect to each other and being arranged to exert a friction force on sections of a paper, the gripping unit further comprising an actuator on which the first friction wheel is mounted for moving the first friction wheel towards the second friction wheel, wherein the first friction wheel is arranged to rotate with respect to its axis during the movement towards the second friction wheel such that a paper section on which the first wheel exerts the friction force is forced into the direction of the second friction wheel, said gripping unit further comprising a guiding element for removing from the stack an element having a surface above the paper to be gripped.

11. A gripping unit for gripping a paper from a top surface of a stack, comprising a first friction wheel and a second friction wheel, said first friction wheel and second friction wheel having rotation axes that are mainly parallel with respect to each other and being arranged to exert a friction force on sections of a paper, the gripping unit further comprising an actuator on which the first friction wheel is mounted for moving the first friction wheel towards the second friction wheel, wherein the first friction wheel is arranged to rotate with respect to its axis during the movement towards the second friction wheel such that a paper section on which the first wheel exerts the friction force is forced into the direction of the second friction wheel, wherein the second friction wheel is allowed to rotate in one direction only.

12. A method for gripping a paper from a top surface of a stack, comprising the steps of exerting friction forces on a first and second section of the paper via a first friction wheel and a second friction wheel, respectively, the friction wheels having rotation axes that are mainly parallel with respect to each other, and moving the first friction wheel towards the second friction wheel while rotating the first friction wheel with respect to its axis such that the first paper section is forced into the direction of the second friction wheel, and providing a flow of air between a paper being gripped and at least one of a surface below the paper and a surface above the paper.

* * * * *